US007012501B2

(12) United States Patent
Krumphals et al.

(10) Patent No.: US 7,012,501 B2
(45) Date of Patent: Mar. 14, 2006

(54) ELECTRICAL MULTI-LAYER COMPONENT

(75) Inventors: Robert Krumphals, Deutschlandsberg (AT); Gunther Greier, Graz-St. Peter (AT); Axel Pecina, Deutschlandsberg (AT); Harald Köppel, Köflach (AT)

(73) Assignee: Epcos AG, Munich (DE)

( * ) Notice: Subject to any disclaimer, the term of this patent is extended or adjusted under 35 U.S.C. 154(b) by 0 days.

(21) Appl. No.: 10/488,518

(22) PCT Filed: Aug. 12, 2002

(86) PCT No.: PCT/DE02/02952

§ 371 (c)(1),
(2), (4) Date: Mar. 3, 2004

(87) PCT Pub. No.: WO03/028045

PCT Pub. Date: Apr. 3, 2003

(65) Prior Publication Data

US 2004/0239476 A1 Dec. 2, 2004

(30) Foreign Application Priority Data

Sep. 10, 2001 (DE) ..... 101 44 364

(51) Int. Cl.
*H01C 7/10* (2006.01)

(52) U.S. Cl. ..... 338/21; 338/332; 338/314; 338/313; 338/325

(58) Field of Classification Search ..... 338/20, 338/21, 307, 313, 314, 324, 325, 332
See application file for complete search history.

(56) References Cited

U.S. PATENT DOCUMENTS

| | | | | |
|---|---|---|---|---|
| 3,266,005 | A * | 8/1966 | Balde et al. | 338/308 |
| 3,846,345 | A * | 11/1974 | Mason et al. | 252/514 |
| 4,568,908 | A | 2/1986 | Laskaris et al. | |
| 4,665,377 | A | 5/1987 | Harpaintner | |
| 4,738,871 | A * | 4/1988 | Watanabe et al. | 427/541 |
| 4,811,164 | A | 3/1989 | Ling et al. | |
| 4,870,746 | A | 10/1989 | Klaser | |
| 5,199,791 | A | 4/1993 | Kasanami et al. | |
| 5,379,016 | A * | 1/1995 | Smith et al. | 338/308 |
| 5,412,357 | A * | 5/1995 | Nakamura et al. | 333/181 |
| 5,430,429 | A * | 7/1995 | Nakamura et al. | 333/226 |
| 5,495,213 | A | 2/1996 | Ikeda | |
| 5,548,268 | A * | 8/1996 | Collins | 338/307 |

(Continued)

FOREIGN PATENT DOCUMENTS

DE 31 25 281 3/1983

(Continued)

OTHER PUBLICATIONS

Englsih Machine translation to Mikio above, JP 11-16703 (Jan. 1999).*

*Primary Examiner*—Karl D. Easthom
(74) *Attorney, Agent, or Firm*—Fish & Richardson P.C.

(57) ABSTRACT

An electrical component includes a base body that contains dielectric layers. The dielectric layers are superimposed and contain ceramic. The component also includes outer contacts on an exterior of the base body, and a resistor in an interior of the base body located between two of the dielectric layers. The resistor is connected to the outer contacts, and is made from a layer that forms a path between the outer contacts. The path between the outer contacts has multiple bends.

21 Claims, 4 Drawing Sheets

U.S. PATENT DOCUMENTS

| | | | | |
|---|---|---|---|---|
| 5,815,367 | A | 9/1998 | Asakura et al. | |
| 5,861,795 | A | 1/1999 | Glatz-Reichenback et al. | |
| 5,870,273 | A * | 2/1999 | Sogabe et al. | 361/306.3 |
| 5,889,445 | A | 3/1999 | Ritter et al. | |
| 6,362,723 | B1 * | 3/2002 | Kawase | 338/22 R |

FOREIGN PATENT DOCUMENTS

| | | | |
|---|---|---|---|
| DE | 33 36 229 | 4/1985 | |
| DE | 41 18 466 | 12/1995 | |
| DE | 196 12 841 | 10/1997 | |
| DE | 101 08 662 | 8/2001 | |
| DE | 100 64 447 | 1/2003 | |
| EP | 1 223 591 | 7/2002 | |
| GB | 570026 | 6/1945 | |
| JP | 2-312203 | * 12/1990 | 29/613 |
| JP | 6-45109 | * 2/1994 | 29/610.1 |
| JP | 9-205004 | * 8/1997 | |
| JP | 11-16703 | * 1/1999 | |

* cited by examiner

ELECTRICAL MULTI-LAYER COMPONENT

TECHNICAL FIELD

The invention relates to an electrical multilayer component that has a base body with a stack of superimposed ceramic dielectric layers. In addition, outer contacts are arranged outside the base body. Inside the base body, a resistor is arranged that is connected to the outer contacts.

BACKGROUND

Multilayer components of the kind mentioned in the introduction are generally produced by so-called multilayer technology. With the help of this technology, for example, multilayer varistors or ceramic capacitors can be produced. In order to give these components specific characteristics in view of their application, it is often necessary to integrate a resistor. Characteristics such as frequency behavior, insertion loss, or even the course of the terminal voltage can be varied in a positive manner when there is an electrical pulse coupled into a varistor. Known ceramic components also contain electrically conducting electrode layers, in addition to dielectric layers, and thus form a stack of superimposed electrode layers separated by dielectric layers. For example, such stacks can form capacitors or varistors.

Multilayer components of the kind mentioned in the introduction are known from publication U.S. Pat. No. 5,889,445, in which one external contact each is arranged on the front and the two long sides of the base body. These components are also known to those skilled in the art by the name "feed-through components". Resistors are integrated into such a known component, which resistors are integrated as a resistance paste along a rectangular path between two ceramic layers. They connect an external contact of the component to an electrode layer that belongs to a capacitor integrated into the component. The resistor structure is located in the same plane as the internal electrodes needed for constructing a capacitor. Series circuits of capacitors and resistors according to the state of the art can thus be integrated into a multilayer component.

The known resistor has the disadvantage that the material forming the resistor is printed along a wide path onto a dielectric layer. This makes it difficult to obtain large resistance values, as are normally desired. According to the state of the art, larger resistances are realized by using special resistor pastes. But, these resistor pastes have the disadvantage that they generally cannot withstand high sintering temperatures>1000° C. that appear during the production of ceramic components. Thus, according to the state of the art, multilayer components are limited to ceramic materials that can be sintered by means of the so-called "LTCC sintering process". This involves a ceramic material that can be sintered at low temperatures<800° C. Naturally, according to this requirement, the selection of ceramic materials is very limited, which means a further disadvantage of the known multilayer component.

SUMMARY

The goal of the present invention is therefore to provide a multilayer component that has high flexibility in the integration of resistors in multilayer components.

This goal is achieved according to the invention by an electrical multilayer component according to patent claim 1. Other embodiments of the invention can be found in the dependent patent claims.

The invention relates to an electric multilayer component that comprises a base body that contains a stack of superimposed ceramic dielectric layers. At least two outer contacts are arranged outside the base body. Inside the base body, a resistor that is connected to the outer contacts is arranged between two dielectric layers. The resistor has the form of a structured layer that forms at least one path with multiple bends as a current path between the outer contacts.

The multilayer component according to the invention has the advantage that, because of the structuring of the layer that forms the resistor, a greater selection of resistor values can be achieved and, in particular, relatively large resistor values can be achieved.

The resistors produced in the form of printed paths according to the conducting-path technology involve, in particular, the ratio of the path length to the width of the path. The longer the path is, the greater its resistance is. The reverse applies as well, as the width of the path decreases, the resistance increases. A large length/width ratio is thus favorable for realizing large resistance. By implementing a resistor in the form of a structured layer—especially with small component sizes—space between the two outer contacts, which is now available only to a limited extent, can be used optimally to form a large resistor. In contrast, a non-bended resistance path running only in a straight line between the two outer contacts can permit only very low resistance. However, although it would be possible by changing the path width, in particular by reducing the path width, to lower the resistance, too low a path width means that the current capacity of the resistor is low, so that the resistor would melt through with a pulsating high-current load that occurs corresponding to the use of the multilayer component or even with a constant direct-current load.

In another advantageous embodiment of the invention, the invention is arranged in a plane of the multilayer component that is free of electrically conducting electrode layers. This means that the entire surface of a plane of the multilayer component is available for forming resistance. Together with the path with multiple bends, an optimally large surface for realizing especially high resistance is made available.

The multilayer component according to the invention permits the dielectric layers to be sintered together with the resistor in a single step because of the structured layer for the resistor. In this way, a monolithic body can be formed that is customary in multilayer technology and has the usual advantages.

With regard to achieving especially large resistances, it is also advantageous if the resistor runs between the outer contacts in the form of a path whose length is at least ten times greater than its width.

In one embodiment of the invention, the resistor can be formed from a closed resistor layer that is later provided with gaps. In this way, the straight-line current path between the outer contacts is broken and the current can be forced onto paths with multiple bends. Higher resistance can be achieved in this way.

In another embodiment of the invention, the resistor can also be formed as a path with a meandering shape. A meandering path with a number of bends permits the realization of a very long current path along the longitudinal direction of the meander. In particular, larger resistance can be realized through a number of superimposed bends implemented in opposite directions.

The resistor material can contain, for example, an alloy of silver and palladium, whereby palladium has a proportion by weight from 15 to <100% in the alloy. Pure palladium can also be used. Such materials are known in multilayer technology in the production of multilayer components. Up to now, however, only electrode layers have been produced from these materials, which have good electrical conductivity. These materials have the advantage that they can be sintered with a large number of ceramic materials. Although they do not have particularly high resistance, the structuring according to the invention can increase the resistance sufficiently.

It is especially advantageous when the resistor material contains an alloy of silver and palladium, whereby palladium exhibits a proportion by weight between 50 and 70% of the alloy. The high palladium proportion, because it has worse conductivity than silver, can increase the resistance by a factor of three.

In addition, the resistance can be increased by forming the resistor from a resistor material that has sheet resistance in the structured layer of at least 0.1 ohm.

The resistance of the resistor material can be increased, for example, by adding additives to the resistor material in addition to an electrically conducting component in a proportion up to 70 vol %. Such additives can have a specific resistance that is at least ten times greater than the specific resistance of the conducting component. In such a case, care must be taken that the conducting components are not insulated in a matrix of insulating additives, since otherwise no conductivity would be present any longer.

Aluminum oxide ($Al_2O_3$) can be considered as an additive, for example.

An alloy of silver and palladium with a weight ratio Ag/Pd=70/30 exhibits sheet resistance of 0.04 Ω for a thickness of 2 $\mu$m. The sheet resistance in this case is the specific resistance of the material divided by the thickness of a layer to be considered in the shape of a rectangle. The resistance of the layer then results from multiplying the sheet resistance by the layer length and then dividing by the layer width. By producing a resistor material that contains 70 vol % $Al_2O_3$ and 30 vol % of the alloy mentioned, the sheet resistance can be increased from 0.04 to 0.12 Ω.

By using a suitable resistor material, it possible to use dielectric layers for the ceramic material whose sintering temperature is between 950 and 1200° C. This has the advantage that, for the multilayer component according to the invention, a large number of ceramic materials are available, whereby it is made possible to produce components with optimal ceramic characteristics.

For example, ceramic materials based on barium titanate can be considered for the dielectric layers. For example, with the help of such ceramic materials, capacitors can be realized.

In addition, a so-called "C0G " ceramic can be considered for use in the dielectric layer. Such a material would be, for example, a (Sm, Ba) $NdTiO_3$ ceramic. In addition to these class 1 dielectrics, so-called class 2 dielectrics can be considered such as, X7R ceramics, for example.

Zinc oxide is especially suitable for the production of a varistor, possibly with additions of praseodymium or bismuth oxide.

There is also the need to produce the ceramic components mentioned with very small external dimensions. This also makes it difficult to obtain larger resistances, since this makes possible only short, straight-line resistance paths. The structure according to the invention of the resistor can achieve sufficiently high resistance values, however.

In a special embodiment of the invention, the multilayer component can be lo designed in such a way that it contains two adjacent multilayer varistors. By a suitable arrangement of one or more resistors, a π-filter can be realized. Such π-filters are based on the fact that multilayer varistors naturally exhibit not insignificant capacitance, in addition to their varistor characteristic, that is responsible for the attenuation behavior of such a filter.

Such a π-filer can be formed in the shape of a component in which two stacks of superimposed electrode layers, separated by dielectric layers, are arranged in the base body next to each other. The electrode layers of the first stack are alternately in contact with the first and second outer contacts of a first pair of outer contacts. Through this alternating contacting, electrode structures that interlock like combs can be realized, which structures are required, for example, in order to achieve high capacitances. Corresponding to the first stack, the electrode layers of the second stack are also in contact with the first and second outer contacts of a second pair of outer contacts.

The connection corresponding to a π-filter of both multilayer components formed in this way through a resistor is realized in that exterior contacts that belong to different pairs and that lie on side areas of the base bodies facing each other are connected by a resistor. The outer contacts of each pair are, in this case, on facing side areas of the base bodies. Altogether, two outer contacts are arranged on each of two side surfaces of the base bodies that face each other. This corresponds to a so-called "feed-through" embodiment of components.

Since the dielectric layers contain a varistor, at least partially, it is possible to provide for each stack of electrode layers being part of a multilayer varistor. Through the resistors connecting the two outer contacts, a π-filter can be formed from the two varistors.

Such a π-filter exhibits improved attenuation behavior because of the increased coupling resistance, whereby a whole frequency band running between the attenuation frequencies of the capacitances of the two varistors defined can be attenuated.

Moreover, it is advantageous if the component is formed symmetrically with respect to a plane that runs parallel to a dielectric layer. For this, it is required, for example, that a resistor be arranged above and below the stack. These resistors would then be wired in parallel. A symmetric embodiment of the component has the advantage that during the mounting of the component onto the circuit board, especially in the case of high-frequency applications, it no longer matters whether the layer stack of the component lies with its lower side or upper side on the circuit board.

The component according to the invention can be produced especially advantageously by sintering a stack of superimposed ceramic green tapes. In this way, a monolithic, compact component is formed that can be produced very rapidly and simply in large quantities.

The component according to the invention can be implemented especially in miniaturized form, whereby the area of the base body is less than 2.5 $mm^2$. Such an area could be realized, for example, through a base body design in which the length is 1.25 mm and the width is 1.0 mm. This component form is also known by the name "0405."

In the following, the invention with be explained in more detail with reference to embodiment examples and the accompanying diagrams:

DESCRIPTION OF THE DRAWINGS

For all diagrams, the same reference numbers also denote the same elements.

DETAILED DESCRIPTION

Figure 1:
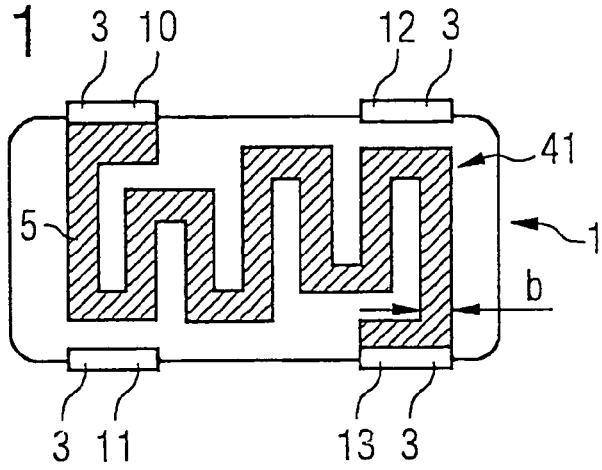
FIG. 1 shows section D—D from FIG. 2.
Figure 2:
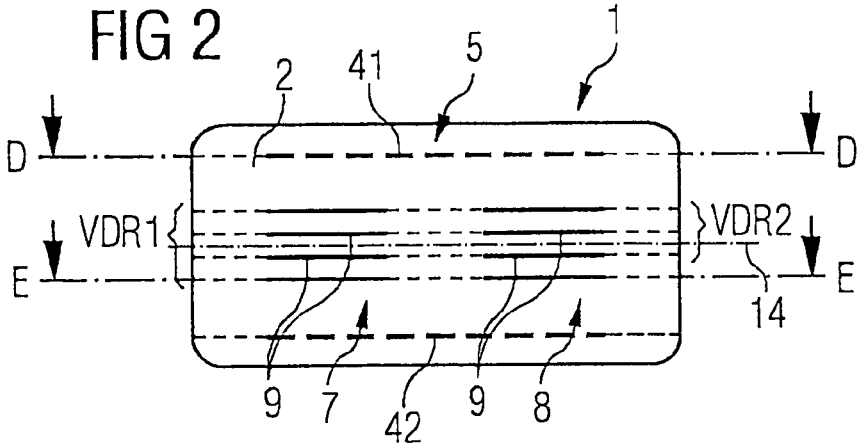
FIG. 2 shows a longitudinal section through a component according to the invention.

FIG. 2 shows a multilayer component according to the invention, in a schematic longitudinal section. It comprises a base body 1 that contains the superimposed dielectric layers 2 in the form of a stack. The dielectric layers 2 contain a ceramic material. They are indicated in FIG. 2 by the dotted lines. The base body 1 also contains stacks 7, 8 of superimposed electrode layers 9. These stacks 7, 8 each form a varistor VDR1, VDR2. Resistors 41, 42 are arranged above and below each of the varistors VDR1, VDR2. The resistors 41, 42 are formed from a structured layer 5, the shape of which can be seen in FIG. 1. In FIG. 2, only individual path segments of a bend can be recognized in cross-section. The component shown in FIG. 2 is symmetric with respect to a plane 14 that runs parallel to the dielectric layers 2. Because of the symmetry, the component has special advantages for applications in the high-frequency range where the orientation of the components on the circuit board is important. A symmetric embodiment of the component means that attention does not have to be paid to the position of the component with respect to the plane of symmetry.

FIG. 1 shows section D—D of the component from FIG. 2. FIG. 1 shows the shape that resistor 41 exhibits. It exhibits the shape of a meander. The meander is formed by a path that has width b. In the example shown in FIG. 1, the width b is 50 $\mu$m. The length of the meander shown in FIG. 1 is approximately 4000 $\mu$m. The length in this case is determined by adding the lengths of the individual straight segments out of which the meander can be thought to be made. Thus, the embodiment of the invention according to FIG. 1 has an L/W ratio of 80 with regard to resistance. Larger resistances can be created in this way. The resistance shown in FIG. 1 is about 3 ohms. The path shown in FIG. 1 is in the form of a structured layer 5, where the layer thickness is approximately 2 $\mu$m. The resistor shown in FIG. 1 is formed from a material that contains a silver-palladium alloy, whereby the alloy has a palladium proportion by weight of 30%. In addition, the starting material of the resistor also contains an organic substance and a solvent. These latter additives are contained in the resistor only in order to be able to apply the resistor to a ceramic layer in the form of a screen-printing paste with the help of a screen-printing process. These components are removed by burning them out during sintering. In this case, organic components are involved.

It can also be seen from FIG. 1 that resistor 41 connects two outer contacts 3 of the component.

It can be further seen from FIG. 1 that the plane shown in FIG. 1 beside resistor 41 contains no electrode layers belonging to a capacitor or a varistor. Accordingly, the entire surface shown in FIG. 1 is available for filling with the meander that forms a resistor.

Figure 3:
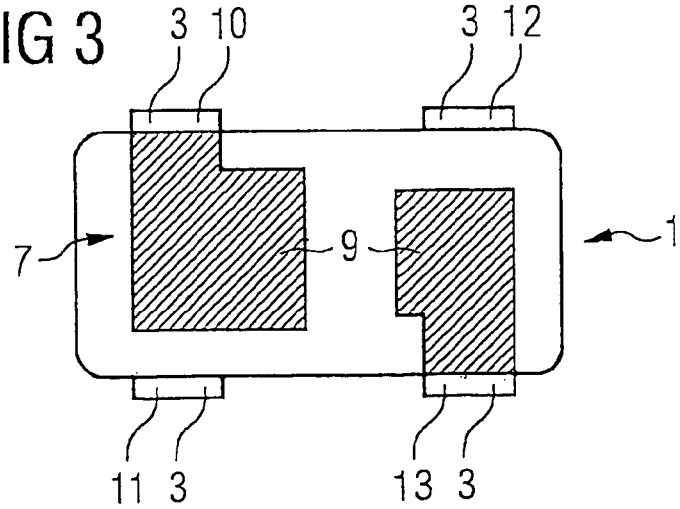
FIG. 3 shows section E—E from FIG. 2.

FIG. 3 shows section E—E of the component from FIG. 2. In FIG. 3, on the left side, an electrode layer 9 of a stack 7 of electrode layers 9 and on the right side electrode layer 9 of a stack 8 of electrodes can be seen. Several similar electrode layers 9 are stacked in the component, one on top of another. They each form a varistor VDR1, VDR2, which also has a high capacitative proportion due to the large opposing areas, because of the varistor material between the electrode layers 9. By comparing FIG. 1 and FIG. 3, it can be seen that the component according to the embodiment example is implemented as a feed-through component. A pair of outer contacts 10, 11 or 12, 13, in alternation, is associated with each stack 7, 8. Within a stack 7, 8 of electrodes 9, contact is made with outer contacts 10, 11 or 12, 13, in alternation. A circuit coupling of the varistors formed by the stacks 7, 8 is achieved by resistor 41 or 42, as can be seen from FIG. 1 or FIG. 2.

Figure 4:
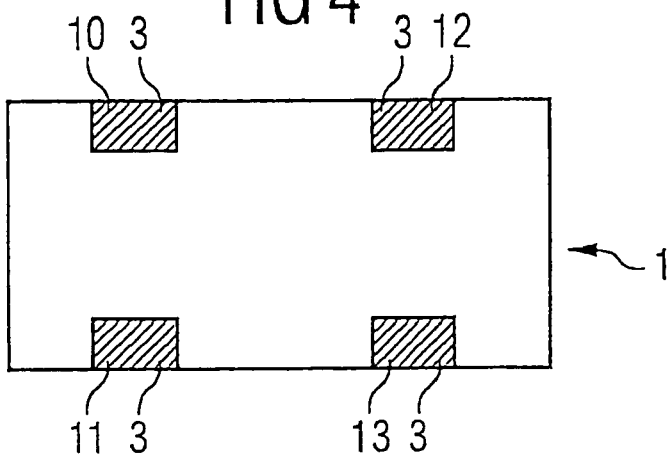
FIG. 4 shows a top view of the component from FIG. 2.
Figure 5:
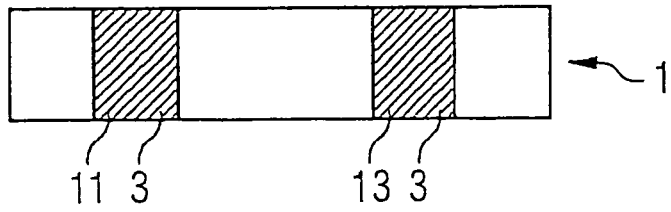
FIG. 5 shows a side view of the component from FIG. 2.

The position of the outer contacts 3 can be seen from FIGS. 4 and 5. They are arranged on two facing side surfaces of the base body 1. The top view of FIG. 4 shows that the outer contacts 3 also surround the upper side or, accordingly, on the lower side of the base body 1. By this means, the component on the upper side or on the lower side can be connected to the circuit board with a surface-mounting technique in a manner to conduct electricity.

Figure 6:
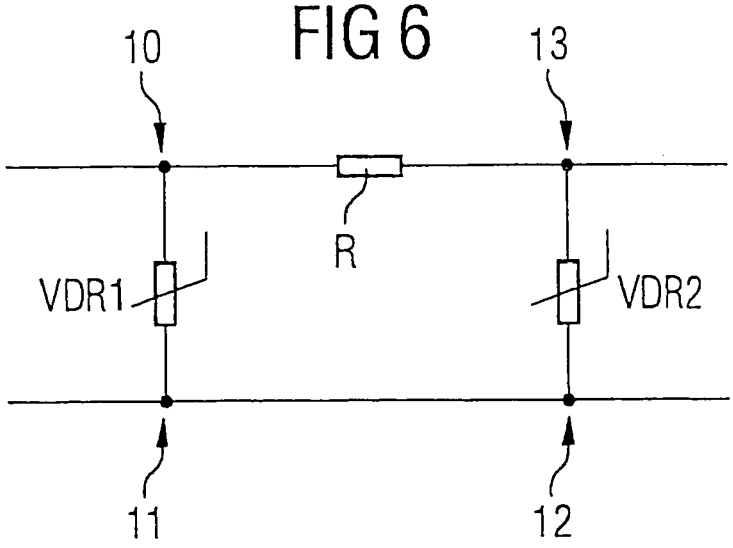
FIG. 6 shows an alternative circuit diagram for the component from FIG. 2.

FIG. 6 shows an alternative circuit diagram of the component according to the invention shown in FIGS. 1 through 3. As such, it can be seen that the two varistors VDR1, VDR2 are coupled to each other by a circuit resistor R to form a $\pi$-filter. The circuit resistor R is formed here by a parallel connection of the two resistors 41, 42 from FIG. 2. This results from the fact that the resistor 42 in FIG. 2 looks just like the corresponding resistor 41 corresponding to FIG. 1. In FIG. 6, the outer contacts 3 of the component are also shown in detail with reference numbers so that the circuit arrangement of the physical outer contacts of the component can take place.

Figure 7:
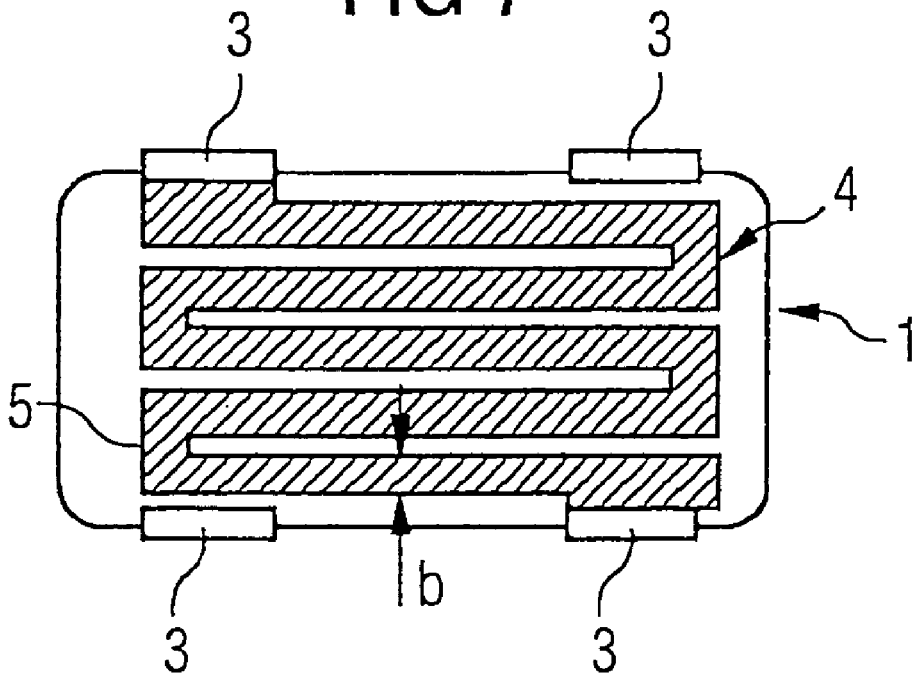
FIG. 7 shows another possible embodiment for the resistor shown in FIG. 1.
Figure 8:
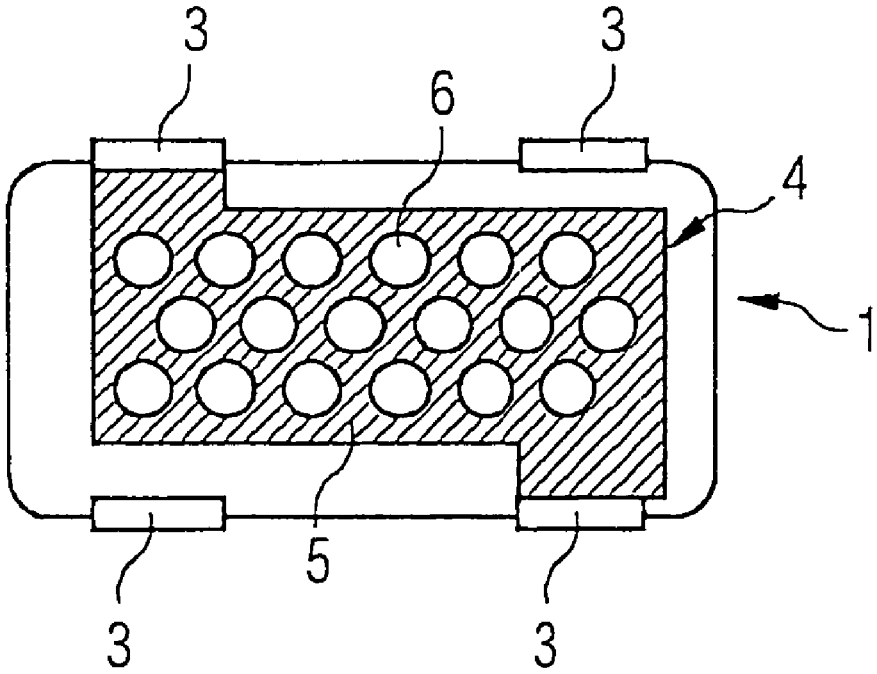
FIG. 8 shows another possible embodiment for the resistor shown in FIGS. 1 and 7.

FIGS. 7 and 8 show other embodiments for a resistor 4 as it could be implemented instead of the resistor 41 shown in FIG. 1. Accordingly, FIG. 7 shows another meander structure for the resistor 4. Here, the layer 5 that forms the resistor 4 is structured in the form of a meander. The meander is formed by a path with width b, which can correspond to width b of FIG. 1. In contrast to FIG. 1, the meander in FIG. 7 does not run in the longitudinal direction of the base body 1 but in the cross-direction.

In FIG. 8, a resistor 4 is shown that is formed out of a rectangular closed layer 5 by arranging gaps 6 in the layer 5. These gaps 6 can be circular, but they can also have other forms such as rectangles, for example. By uniformly distributing a number of gaps 6, the resistance of the original rectangular layer 5 can be increased significantly. As an effect of the gaps 6, a large number of multiply bended current paths results between the outer contacts 3 that exhibit high resistance.

Figure 9:
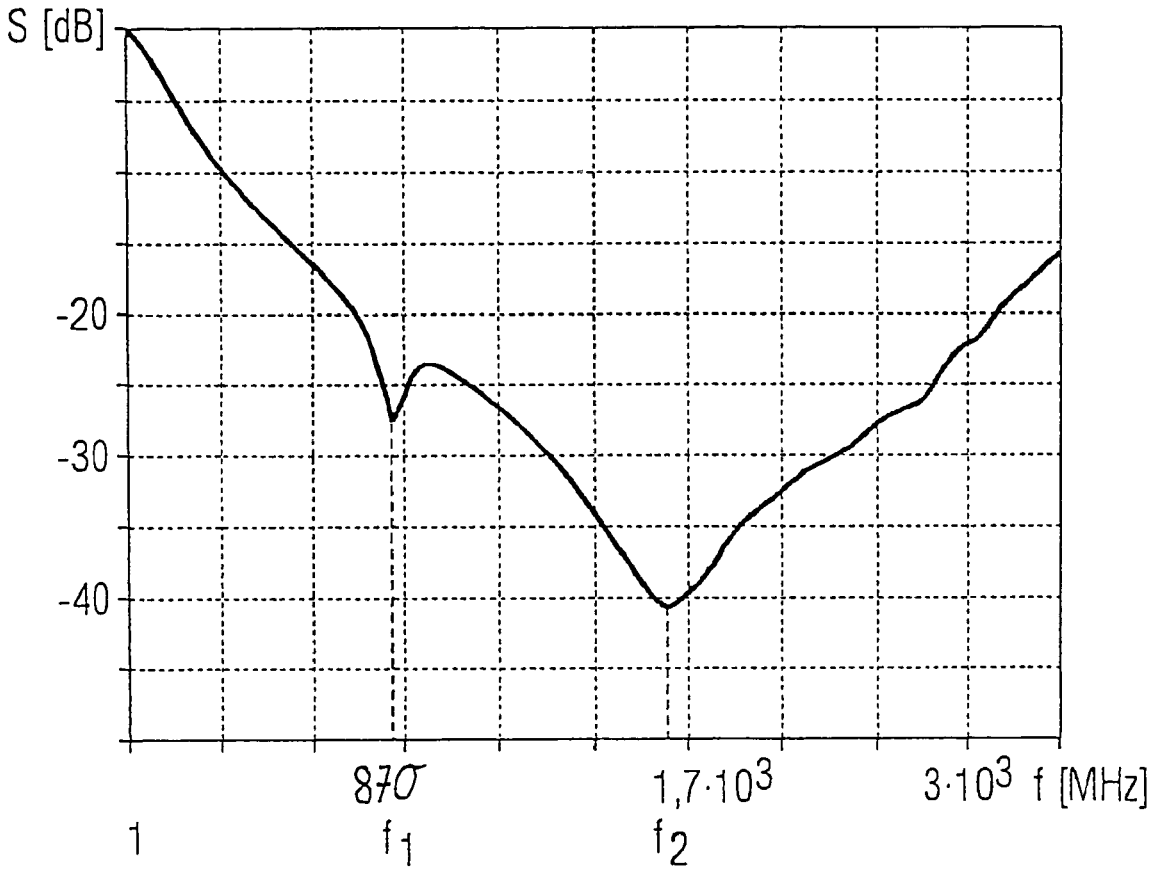
FIG. 9 shows schematically the attenuation behavior of a component according to FIG. 2.

FIG. 9 shows the insertion loss of the components shown in FIG. 2 or FIG. 6. The insertion loss S is measured in dB units at a frequency f (MHz). Through capacitances C1, C2 contained in the varistors VDR1, VDR2, resonant frequencies $f_1$, $f_2$ are formed. At the points of the resonance frequencies $f_1$, $f_2$, the component shows increased attenuation. Also between resonant frequencies, $f_1$, $f_2$, because of the resistor R realized because of the $\pi$-circuit, the component has very good attenuation, which is better than −20 dB in the frequency interval between 740 MHz and 2.7 GHz. By this means, the component is suitable for suppressing a frequency range that lies between resonant frequency $f_1$ (belongs to C1) and resonant frequency $f_2$ (belongs to C2). The resonant frequencies $f_1$ and $f_2$ are defined by capacitances C1 and C2 of the varistors VDR1 and VDR2, which can be determined by converting the frequencies to C1=40 pF and C2=20 pF. The resistor R in the embodiment example shown in the Figures is 1.8 Ω.

What is claimed is:

1. An electrical component comprising:

a base body; and outer contacts on an exterior of the base body;

wherein the base body comprises:

dielectric layers that are stacked and that contain ceramic;

electrode layers that are stacked;

a first resistor between two of the dielectric layers, the first resistor being connected to the outer contacts, the first resistor comprising a layer that forms a first path between outer contacts, and the first resistor being above the electrode layers; and a second resistor between two of the dielectric layers, the second resistor being connected to the outer contacts, the second resistor comprising a layer that forms a second path between outer contacts, and the second resistor being below the electrode layers;

wherein the dielectric layers comprise a ceramic layer, the ceramic layer comprising a varistor ceramic, and wherein a sintering temperature of the ceramic layer is between 950° C. and 1200° C.

2. The electrical component according to claim 1, wherein the dielectric layers and the first and second resistors are sintered together.

3. The electrical component according to claim 1, wherein a surface in the base body that contains the first resistor or the second resistor does not contain an electrode layer.

4. The electrical component according to claim 1, wherein a length of the first path or the second path is at least ten times larger than a width of the first path or the second path, respectively.

5. The electrical component according to claim 1, wherein at least one of the first path and the second path meanders.

6. The electrical component according to claim 1, wherein at least one of the first resistor and the second resistor is formed of a resistive material having a resistance of at least 0.1 ohm.

7. The electrical component according to claim 1, wherein at least one of the first resistor and the second resistor is formed from a resistive material that contains an alloy comprised of silver and palladium, the palladium having a proportion in the alloy from 15% to less than 100% by weight.

8. The electrical component according to claim 7, wherein the proportion of palladium is between 50% and 70% by weight.

9. The electrical component according to claim 1, wherein at least one of the first resistor and the second resistor is comprised of a material that contains up to 70% by volume of an additive that has a specific resistance that is at least ten times larger than a specific resistance of other components of the material.

10. The electrical component according to claim 9, wherein the additive comprises $Al_2O_3$.

11. The electrical component according to claim 1, wherein the ceramic layer is based on $BaTiO_3$.

12. The electrical component according to claim 1, wherein:

the electrode layers comprise first and second stacks of electrode layers that are arranged side-by-side in the base body;

the outer contacts comprise first and second pairs of outer contacts that are connected by the first and second resistors, the first pair of outer contacts comprising one outer contact on each of two facing side areas of the base body, and the second pair of outer contacts comprising one outer contact on each of the two facing side areas of the base body;

adjacent electrode layers in the first stack of electrode layers contact alternate outer contacts in the first pair of outer contacts; and adjacent electrode layers in the second stack of electrode layers contact alternate outer contacts in the second pair of outer contacts.

13. The electrical component according to claim 12, wherein the first and second stacks of electrode layers are each part of a different multilayer varistor.

14. The electrical component according to claim 13, wherein two varistors that include the first and second stacks of electrode layers, together with the first resistor and the second resistor, form ; a π-filter.

15. An electrical component comprising:

a base body that has facing side areas;

outer contacts on an exterior of the base body, the outer contacts comprising a first pair of outer contacts and a second pair of outer contacts, the first pair of outer contacts comprising one outer contact on each facing side area of the base body, and the second pair of outer contacts comprising one outer contact on each facing side area of the base body;

wherein the base body comprises:

dielectric layers that are stacked and that contain ceramic;

first and second stacks of electrode layers arranged side-by-side, the first stack of electrode layers being part of a first multilayer varistor and the second stack of electrode layers being part of a second multilayer varistor, wherein adjacent electrode layers in the first stack of electrode layers contact alternate outer contacts in the first pair of the outer contacts, and wherein adjacent electrode layers in the second stack of electrode layers contact alternate outer contacts in the second pair of the outer contacts;

a first resistor above the first and second stacks of electrode layers, the first resistor being between two of the dielectric layers, the first resistor being connected to an outer contact in the first pair of outer contacts and to an outer contact in the second pair of outer contacts, and the first resistor comprising a layer that forms a first path between outer contacts connected to the first resistor, the first path having multiple bends; and a second resistor below the first and second stacks of electrode layers, the second resistor between two of the dielectric layers, the second resistor being connected to an outer contact in the first pair of outer contacts and to an outer contact in the second pair of outer contacts, and the second resistor comprising a layer that forms a second path between two outer contacts connected to the second resistor, the second path having multiple bends; and wherein the electrical component is symmetric relative to a plane that runs parallel to one of the dielectric layers, and wherein the first and second multilayer varistors and the first and second resistors form a π-filter.

16. The electrical component of claim 1, wherein at least one of the first resistor and the second resistor comprises a continuous layer having multiple holes.

17. The electrical component of claim 1, wherein at least one of the first path and the second path has multiple bends.

18. The electrical component of claim 15, wherein at least one of the first resistor and the second resistor comprises a continuous layer having multiple holes.

19. An electrical component comprising:

a base body; and outer contacts on an exterior of the base body;

wherein the base body comprises:

dielectric layers that are stacked and that contain ceramic;

electrode layers that are stacked, the electrode layers comprising first and second stacks of electrode layers that are arranged side-by-side in the base body;

a first resistor between two of the dielectric layers, the first resistor being connected to the outer contacts, the first resistor comprising a layer that forms a first path between outer contacts, and the first resistor being above the electrode layers; and a second resistor between two of the dielectric layers, the second resistor being connected to the outer contacts, the second resistor comprising a layer that forms a second path between outer contacts, and the second resistor being below the electrode layers;

wherein the outer contacts comprise first and second pairs of outer contacts that are connected by the first and second resistors, the first pair of outer contacts comprising one outer contact on each of two facing side areas of the base body, and the second pair of outer contacts comprising one outer contact on each of the two facing side areas of the base body;

wherein adjacent electrode layers in the first stack of electrode layers contact alternate outer contacts in the first pair of outer contacts; and wherein adjacent electrode layers in the second stack of electrode layers contact alternate outer contacts in the second pair of outer contacts.

20. The electrical component according to claim 19, wherein the first and second stacks of electrode layers are each part of a different multilayer varistor.

21. The electrical component according to claim 20, wherein two varistors that include the first and second stacks of electrode layers, together with the first resistor and the second resistor, form a π-filter.

* * * * *